US006427759B1

(12) United States Patent
Bauer et al.

(10) Patent No.: US 6,427,759 B1
(45) Date of Patent: Aug. 6, 2002

(54) INVESTMENT CAST STAINLESS STEEL MARINE PROPELLER

(75) Inventors: Richard S. Bauer; Barry L. Riutta; Terrance M. Cleary; Raymond J. Donahue; Kevin R. Anderson, all of Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 11 days.

(21) Appl. No.: 09/585,136

(22) Filed: Jun. 1, 2000

(51) Int. Cl.[7] ..... B22C 9/00; B22C 9/04; C22C 38/18

(52) U.S. Cl. ..... 164/516; 164/35; 420/34

(58) Field of Search ..... 164/516, 35; 420/34

(56) References Cited

U.S. PATENT DOCUMENTS 3,661,658 A * 5/1972 Oda et al. ..... 148/542
3,915,756 A * 10/1975 Oda et al. ..... 148/542
3,925,064 A * 12/1975 Takamura et al. ..... 75/128 A
4,975,041 A * 12/1990 Fries et al. ..... 425/547
4,981,167 A * 1/1991 Anderson ..... 164/35
5,089,067 A * 2/1992 Schumacher ..... 148/325

FOREIGN PATENT DOCUMENTS

JP 60-029451 * 2/1985 ..... B63H/1/00

* cited by examiner

*Primary Examiner*—M. Alexandra Elve
*Assistant Examiner*—Kevin P. Kerns
(74) *Attorney, Agent, or Firm*—Andrus, Sceales, Starke & Sawall, LLP

(57) ABSTRACT

An investment cast stainless steel article, such as a marine propeller, is composed of a stainless steel alloy containing from 14.5 to 15.2% chromium, 5.35% to 6.05% nickel and 1.0% to 1.5% silicon. During the investment casting procedure, the increased silicon in the stainless steel lowers the driving force for the silicon from reacting with the molten metal, thereby reducing casting defects and decreasing the time and labor required for final grinding and polishing of the propeller

1 Claim, No Drawings

INVESTMENT CAST STAINLESS STEEL MARINE PROPELLER

BACKGROUND OF THE INVENTION

Marine propellers, particularly those used for high performance marine engines, are usually formed of stainless steel. The traditional method of producing a stainless steel propeller is to cast the propeller by a conventional lost wax casting procedure using a 15-5 stainless steel which contains approximately 15% chromium and 5% nickel. After casting, the outer diameter of the propeller hub is machined, and the outer surface of the propeller is then ground to eliminate any pin holes or microporosity. Following the grinding, the propeller is then polished to a high luster. If the cast propeller contains larger casting defects, such as gas holes, it is necessary to repair the larger defects through welding and the welded areas are then ground before the propeller is polished to its final condition.

The grinding and welding operations require considerable time and labor and, therefore, constitute a substantial portion of the overall cost of the stainless steel propeller.

SUMMARY OF THE INVENTION

The invention is based on the discovery that by employing a stainless steel containing in excess of 1% silicon, and preferably a silicon content in the range of 1.0% to 1.5% by weight, pin hole and porosity casting defects can be considerably reduced, thereby reducing the time and labor required in the welding, grinding and polishing operations for the propeller.

In general, pin holes and the larger defect form, gas porosity, traditionally result from the carbon dissolved in the metal reacting with oxygen either dissolved in the metal or blown into the metal. The resulting carbon dioxide gas is trapped under the solidified skin and is visible as gas porosity. For low carbon ferrous alloys, like 15-5 pH, stainless steel, that are well deoxidized inherently by their high levels of chromium, pin holes and gas porosity are not expected to be a problem. However, in an investment or lost wax casting process in which the molten stainless steel is fed into a silica mold or shell, metal/mold reactions can occur that result in gas porosity and thereby increase the manufacturing cost of primary and secondary cleaning operations and/or that can compromise the quality of the cast metal. This invention specifically addresses the pin hole and porosity problem that occurs in the near surface regions (e.g. approximately 0.050 inches below the surface) of investment cast martensitic and of martensitic precipitation hardened stainless steel that use a silica shell. Porosity can be eliminated by deep grinding or by changing the shell system to alumina shells, but both of these solutions have an adverse economic impact on the overall process. Instead it has been unexpectedly found that by raising the silicon level of the stainless steel about 50%, from under 0.8% by weight in the conventional practice, to 1.2% and above, the reaction between the molten steel and the silica shell substantially stops or is dramatically reduced, and thus the more economical process of light grinding of propellers can be used.

It is believed that the increased silicon dissolved in the molten steel thermodynamically lowers the driving force for the silica shell from reacting with the molten metal, much like the mechanism in die casting where dissolving iron in a molten aluminum alloy decreases "die sticking" or the tendency of the steel die from reacting with an iron-free aluminum alloy.

The increased silicon content also increases the fluidity of the alloy during casting, resulting in a reduction in non-fill defects, as well as a reduction in cold lap defects in the cast article.

The increased silicon content also reduces the hardness of the cast article, which correspondingly facilitates the grinding operation on the cast propeller.

Other features, objects and advantages will appear in the course following description.

DESCRIPTION OF THE PREFERRED EMBODIMENT

The invention is directed to a cast stainless steel article, such as a marine propeller, having reduced casting defects and improved mechanical properties. The stainless steel to be used is a variation of a conventional 15-5 stainless steel (15% chromium, 5% nickel) containing in excess of 1% silicon and preferably from 1.0% to 1.5% by weight of silicon.

In general, the stainless steel has the following composition in weight percent:

| | |
|---|---|
| Chromium | 14.5% to 15.2% |
| Nickel | 5.35% to 6.05% |
| Silicon | 1.0% to 1.5% |
| Copper | 2.8% to 3.5% |
| Niobium | 0.15% to 0.45% |
| Tantalum | 0.15% to 0.45% |
| Carbon | 0.05% max |
| Sulfur | 0.025% max |
| Iron | Balance |

The marine propeller is cast using a conventional investment or lost wax casting procedure to obtain close tolerances. In a lost wax casting procedure, a pattern is initially formed of wax having a shape and size identical to the propeller to be ultimrately cast. The wax pattern is then dipped or otherwise coated with a thin aqueous slurry of silica, and the slurry is subsequently dried to provide a thin dry silica coating on the wax pattern. Several additional silica coats are applied in the same manner to produce an outer silica shell on the wax pattern. The resulting composite structure is then heated, preferably in an autoclave, to melt the wax, leaving a hollow silica shell into which the molten stainless steel is fed to produce a cast article identical in size and shape to the original wax pattern.

In the past when casting propellers using a conventional 15-5 stainless steel, the cast article may contain some surface and sub-surface defects, such as microporosity or pinholes, which are removed from the pattern by grinding. Quite often the cast propeller will also include larger defects, such as gas holes or voids, which require repair by welding. The welded areas must be subsequently ground and polished. The after-casting procedures, such as welding, grinding and polishing, require substantial time and labor which contribute greatly to the overall cost of the propeller.

It has unexpectedly been found that by increasing the silicon content of the stainless steel to a value in excess of 1.0% by weight, reaction between the silica mold and the molten stainless steel is favorably controlled and, as a result, the surface and sub-surface defects of the casting are reduced. It is believed that the increased silicon in the molten stainless steel thermodynamically reduces the driving force for the silica shell from reacting with the molten metal, thus reducing gas-formed defects. By reducing the defects, such as pinholes, gas holes and the like, the amount of labor required for grinding of the propeller is correspondingly reduced. Further, the increased silicon content also increases the fluidity of the stainless steel during casting. The increased fluidity serves to reduce non-fill defects in the casting, as well as cold-lap defects. Non-fill defects are areas of the casting which are not properly filled with the molten metal, while cold-lap defects are areas where two molten metal fronts met but did not properly fuse.

To show the advantages of the invention, a series of tests were conducted to compare cast stainless steel propellers composed of a conventional 15-5 stainless steel with cast propellers using a stainless steel having an increased silicon content. In carrying out these tests, a series of twelve propellers (indicated by A in the subsequent table) were cast by a conventional investment or lost wax casting procedure using a silica shell and a standard 15-5 stainless steel having the following composition in weight percent:

| | |
|---|---|
| Chromium | 14.1% |
| Nickel | 5.35% |
| Silicon | 0.92% |
| Copper | 3.04% |
| Carbon | 0.017% |
| Manganese | 0.44% |
| Niobium | 0.17% |
| Tantalum | 0.015% |
| Sulfur | 0.007% |

Each propeller had a hub with a 4.75 inch OD and three 4.625 inch blades (e.g. 14.0 inch OD blade propeller).

A second series of twelve propellers B were cast having the identical size and shape and using the same lost wax casting procedure with a silica shell, but in this case, the propellers were composed of a stainless steel having increased silicon and having the following composition in weight percent:

| | |
|---|---|
| Chromium | 14.1% |
| Nickel | 5.39% |
| Silicon | 1.24% |
| Copper | 3.02% |
| Manganese | 0.44% |
| Niobium | 0.17% |
| Tantalum | 0.014% |
| Sulfur | 0.009% |

All of the cast propellers were examined for microporosity and larger defects, such as gas holes. The larger defects were then welded.

The following table shows the results of the tests:

TABLE 1

| | | Back of Blade | | | Front of Blade | | |
|---|---|---|---|---|---|---|---|
| Propeller | | Gas Holes | Pin Holes | Hub | Gas Holes | Pin Holes | Welds |
| A | Average | 12.4 | 3.7 | 3.3 | 8.6 | 5.03 | 3.9 |
| | Range | 22 | 7 | 9 | 22 | 5 | 8 |
| B | Average | 7.3 | 2.3 | 3.0 | 3.8 | 2.2 | 0.8 |
| | Range | 13 | 3 | 4 | 9 | 3 | 3 |
| | Average Difference | −42% | −39% | −8% | −56% | −57% | −79% |
| | Range Difference | −41% | −57% | −56% | −59% | −40% | −63% |

The term "Average" as used in the above Table indicates the average number of either gas holes or pinholes that were observed in the back or front of the blade or in the hub. The term "Range" is the difference between the highest and lowest number of defects in the specified area of the propeller. The term "Welds" indicates the number of welds that was required to repair larger defects in the propellers.

The results, as shown in the above Table, indicates that the average number of pinholes and gas holes in the blades, and the hub was substantially reduced in Propeller B by utilizing a stainless steel having the increased silicon content. More particularly, the average number of gas holes was reduced by 42%, and 56% in the back and front of the blade, respectively, while the average number of pinholes in the back and front of the blade was reduced by 59% and 57%, respectively. The average number of defects in the hub was reduced by 8% and the average number of welds required to repair layer defects was dramatically reduced by 79%. A corresponding decrease was also noted in the range of the defects.

The test data illustrates that the stainless steel alloy having an increased silicon content in the range of 1.0% to 1.5% by weight unexpectedly reduces the casting defects in the propeller and this substantially reduces the costs of the after-casting operations, such as grinding, welding and polishing.

The increased silicon content of the stainless steel when used with a silica shell in investment casting also reduces the hardness of the cast propeller which correspondingly facilitates the grinding operation. The following table shows the reduction in hardness in various locations on the hub of propellers A (0.92% silicon) and propellers B (1.24% silicon):

TABLE 2

| Propeller A Hardness Hub Rockwell C | | Propeller B Hardness Hub Rockwell C | |
|---|---|---|---|
| | 33.8 | | 32.7 |
| | 32.5 | | 32.3 |
| | 32.5 | | 35.6 |
| | 44.1 | | 34.3 |
| | 36.1 | | 32.4 |
| | 34.9 | | 34.9 |
| | 43.4 | | 37.5 |
| | 31.2 | | 33.0 |
| | 34.7 | | 34.7 |
| Total | 323.2 | Total | 307.4 |
| Average | 35.9 | Average | 34.2 |
| Range | 12.9 | Range | 5.2 |

While the above description has shown the invention to be used in casting a marine propeller, it is contemplated that the invention can also be employed in casting other articles.

Various modes of carrying out the invention are contemplated as being within the scope of the following claims particularly pointing out and distinctly claiming the subject matter regarded as the invention.

We claim:

1. A method of casting a marine propeller, comprising the steps of producing a wax pattern substantially identical in configuration to a marine propeller to be cast, coating the wax pattern with a layer of ceramic material to produce a ceramic shell, removing the wax pattern from the interior of the shell, feeding a molten stainless steel consisting essentially of in weight percent:

| | |
|---|---|
| Chromium | 14.15% to 15.2% |
| Nickel | 5.35% to 6.05% |
| Silicon | 1.0% to 1.5% |
| Copper | 2.8% to 3.5% |
| Niobium | 0.15% to 0.45% |
| Tantalum | 0.15% to 0.45% |
| Carbon | 0.05% max |

-continued

| | |
|---|---|
| Manganese | 0.45% max |
| Sulfur | 0.025% max |
| Iron | Balance |

into the interior of the shell, and solidifying the molten stainless steel to produce a cast propeller substantially identical in configuration to said wax pattern, said silicon acting to decrease reaction between the ceramic material of the shell and the molten stainless steel to thereby minimize porosity defects in the cast propeller.

* * * * *